US006085368A

United States Patent [19]

Robert et al.

[11] Patent Number: 6,085,368

[45] Date of Patent: Jul. 11, 2000

[54] PERSON LOWERING AND RAISING WINCH ASSEMBLY

[75] Inventors: Stéphane Robert, Magog; Michel Corriveau, Sherbrooke; Martin Faucher, Magog, all of Canada

[73] Assignee: BHM Médical Inc., Magog, Canada

[21] Appl. No.: 08/991,765

[22] Filed: Dec. 16, 1997

[30] Foreign Application Priority Data

Oct. 3, 1997 [CA] Canada ..... 2217421

[51] Int. Cl.[7] ..... A61G 7/10

[52] U.S. Cl. ..... 5/85.1; 5/83.1; 5/87.1; 74/405; 74/400; 74/425

[58] Field of Search ..... 5/83.1, 87.1, 84.1, 5/85.1, 89.1, 86.1; 254/301, 309, 317, 365, 346, 170; 212/159; 74/405, 425, 400, 402

[56] References Cited

U.S. PATENT DOCUMENTS

| | | | |
|---|---|---|---|
| 1,518,473 | 12/1924 | Whaler . | |
| 1,592,121 | 7/1926 | Moore . | |
| 2,505,435 | 4/1950 | Schmidt | 254/170 |
| 3,351,959 | 11/1967 | Turpin | 5/83.1 |
| 3,877,421 | 4/1975 | Brown . | |
| 4,152,682 | 5/1979 | Ito et al. . | |
| 4,372,452 | 2/1983 | McCord | 212/159 |
| 4,489,919 | 12/1984 | Ostrobrod | 254/346 |
| 4,515,024 | 5/1985 | Kataoka et al. . | |
| 4,805,248 | 2/1989 | Lunau . | |
| 4,884,784 | 12/1989 | Herman et al. . | |
| 5,379,468 | 1/1995 | Cassidy et al. . | |
| 5,573,091 | 11/1996 | Michael . | |
| 5,649,329 | 7/1997 | Horcher et al. . | |

FOREIGN PATENT DOCUMENTS

| | | |
|---|---|---|
| 2411295 | of 0000 | France . |
| 982.953 | 2/1951 | France . |
| 889213 | 9/1953 | Germany . |
| 8803606 | 3/1988 | Germany . |
| 94 13 618 | 10/1994 | Germany . |
| WO 93/06810 | 4/1993 | WIPO . |

*Primary Examiner*—Michael F. Trettel
*Assistant Examiner*—Fredrick Conley
*Attorney, Agent, or Firm*—Ronald S. Kosie; Robert Brouillette; Nicolas Pellemans

[57] ABSTRACT

A device is provided for a system for displacing (e.g. lifting, transporting, lowering, etc.) persons between various positions or areas such as for example between a bed and a chair, a bed and a bathroom etc. The device comprises a winch assembly whereby a reel component and a motor may be decoupled so as to allow for the manual paying out of an elongated flexible support member to facilitate the attachment thereto of a harness holding a person.

16 Claims, 15 Drawing Sheets

PERSON LOWERING AND RAISING WINCH ASSEMBLY

The present invention relates to a device or system for displacing (e.g. lifting, transporting, lowering, etc.) persons between various positions or areas such as for example between a bed and a chair, a bed and a bathroom etc.

The present invention particularly relates to a patient-handling system or apparatus for the displacement of non-ambulatory patients. It is necessary for example, on occasion to transfer a bed ridden patient from a bed to a wheel chair, to a bath tub or the like. It is known to use lift devices for this purpose. Such devices are for example disclosed in U.S. Pat. Nos. 3,877,421, 5,379,468 and 5,649,329. Such known devices are relatively bulky and complicated to use; in cases wherein a known handling system is more or less portable the entire system must nevertheless be displaced to a new location.

It would be advantageous to have a relatively simple system for handling persons. It would in particular be advantageous to have a relatively flexible handling system which does not require the displacement of the entire handling system when going from one location to another.

It would further be advantageous to have a means for facilitating the initial attachement of a person to a person handling system.

STATEMENT OF INVENTION

The present invention in accordance with one aspect provides a person lowering and raising winch assembly comprising

- a support structure
- an electric motor
- a flexible elongated support member
- a reel component connected to said support structure for winding up and paying out (i.e. unwinding) said
- flexible elongated support member,
- a clutch coupling component configured to be able to couple and de-couple said electric motor and said reel component when said motor is in a non-energised state such that
  - when said electric motor and said reel component are coupled and said motor is in an energised state said reel component may be rotated by said motor and
  - when said electric motor and said reel component are de-coupled said flexible elongated support member may be manually paid out (i.e. unwound) from said reel component; in a non-energised state no electrical power is being delivered to the motor so its shaft is not turning; in an energised state electrical power is being delivered to the motor for turning it's shaft.

As mentioned above, in accordance with the present invention the winch assembly may be configured such that when the electric motor and said reel component are coupled and the motor is in an energised state the reel component may be rotated by said motor. The winch assembly (i.e. the motor, the clutch coupling component, etc.) may, for example, be appropriately configured in any suitable (known) manner such that the motor induced rotation of the reel component in one direction leads to the flexible elongated support member being wound up onto the reel component whereas motor induced rotation of the reel component in the opposite direction leads to the flexible elongated support member being unwound or paid out from the reel component.

In accordance with the invention the winch assembly may be configured such that when the electric motor and the reel are de-coupled an extended flexible elongated support member may be manually rewound with the assistance of a (known) spring rewind mechanism.

The clutch coupling component may take any desired or necessary configuration keeping in mind its intended purpose, i.e. to be able to couple and de-couple the electric motor and the reel component. The clutch component may for example comprise a pair of gear elements which may as desired be engaged or disengaged as the case may be. The gear elements may take any desired or necessary form keeping the above in mind.

The present invention in particular provides a person lowering and raising winch assembly comprising

- a support structure
- a worm drive gear,
- an electric motor coupled or connected to said worm drive gear for urging the worm drive gear to rotate, said worm drive gear, when said motor is in a non-energised state, being displaceable between a working position and a non-working position,
- a flexible elongated support member connected to a reel component for unwinding and winding up said flexible elongated support member, said reel component being connected to said support structure,
- gear means coupled to said reel component for urging said reel component to rotate, said
- gear means being provided with a plurality of peripheral worm gear teeth configured to mesh with and be driven by the worm drive gear,
- a spring element biassing the worm drive gear in said working position,
- a worm gear displacement component for releasably displacing said worm drive gear from said working position to said non-working position and
- wherein when the worm drive gear is in said working position, the worm drive gear engages said worm gear teeth for rotation of said reel component when said electric motor is in an energised state (i.e. appropriate motor induced rotation of the reel component may induce the flexible elongated support member to be wound up onto or paid out from the reel component) and wherein when said worm drive gear is in said non-working position the worm drive gear is disengaged from said worm gear teeth and the flexible elongated support member is able to be manually unwound from the reel component.

The reel component may take on any desired configuration as long as it takes the form of a rotary device on which an elongated flexible support member may be wound and may be unwound or paid out. The elongated flexible support member may for example be a wire, a strap, a band, a cable, or the like.

In accordance with the present invention, the reel itself may have a raised element (e.g. rim) provided with a plurality of peripheral worm gear teeth configured to mesh with and be driven by the worm gear, i.e. the reel component may be configured to have a portion which has a gear function. The reel component may for example comprise a cylindrical body with rimmed ends, one of the rimmed end being provided with a plurality of peripheral worm gear teeth.

Thus the present invention in particular provides a person lowering and raising winch assembly comprising

- a support structure
- a worm drive gear, an electric motor connected to said worm drive gear for urging the worm drive gear to rotate, said worm drive gear, when said motor is in a non-energised state, being displaceable between a working position and a non-working position, a flexible elongated support member connected to a reel component for unwinding and winding up said flexible elongated support member, said reel component being connected to said support structure, said reel component having a rim element provided with a plurality of peripheral worm gear teeth configured to mesh with and be driven by the worm drive gear, a spring element biassing the worm drive gear in said working position, a worm gear displacement component for releasably displacing said worm drive gear from said working position to said non-working position and wherein when the worm drive gear is in said working position, the worm drive gear engages said worm gear teeth for rotation of said reel component when said electric motor is in an energised state (i.e. appropriate motor induced rotation of the reel component may induce the flexible elongated support member to be wound up onto or paid out from the reel component) and wherein when said worm drive gear is in said non-working position the worm drive gear is disengaged from said worm gear teeth and the flexible elongated support member is able to be manually unwound from the reel component.

A winch assembly as described above may be used as part of a person handling system. It may, in particular, be a portable type component which may be transferred from one working area to another without having to transfer all of the handling system therewith, i.e. each working area could be provided with a separate trolley/track combination as shall be discussed herein.

Thus, in accordance with another aspect the present invention provides a person handling system comprising a) an overhead track component comprising a track b) a trolley component comprising a carriage and c) a person lowering and raising winch assembly as defined above connected to said carriage said overhead track component and said trolley component being configured such that said carriage engages said track such that said carriage is able to glide along said track.

In accordance with the present invention a person handling system as defined above may comprise a harness component for holding a person, and the support structure of the winch assembly may be connected to the carriage and said flexible elongated support member may be connected to said harness component.

Alternatively in accordance with the present invention a person handling system as defined above may comprise a harness component for holding a person, and the flexible elongated support member of the winch assembly may be connected to the carriage and said support structure may be connected to said harness component.

A harnes may be of any suitable type and may for example include a number of harness attachement straps. A harness may be attached in any (suitable) way to a winch assembly.

The incorporation into a person handling system of a winch assembly as described herein may facilitate the attachement of a harness holding a person to the winch assembly, i.e. the manual paying out of the elongated flexible support member may be accomplished relatively quickly.

The winch assembly may be connected to the carriage in any desired way. A winch assembly may be constructed so as to be of relatively light weight and may for example be releasable connectable to a carriage by suitable releasable connection means e.g. by a hook and eyelet combination. If a winch assembly is realisable connectable to a carriage then two or more rooms may be provided with an appropriate trolley/track combination and a single winch assembly may be transfered from room to room for as needed, i.e. each room need not be provided with an individual winch assembly.

The motor may be any suitable or desired (known) type of electric motor; if desired, it may be a variable speed motor, a reversible motor, a non-reversible motor, etc. The motor may if desired or as necessary be associated with other mechanical/electrical elements (e.g. gear reduction elements, rotational speed variation means, gear means for changing the direction of rotation of the worm gear drive shaft, etc.).

In accordance with the present invention a person lowering and raising winch assembly may comprise braking means for braking the unwinding of the flexible elongated support member from the reel component.

In accordance with the present invention a person lowering and raising winch may comprise a braking component for braking the unwinding of the flexible elongated support member from the reel component and wherein said braking component and said reel component are configured such that said braking component is attached to said reel component so as to have a braking configuration and a non-braking configuration and such that said braking component is able to be centrifugally displaced from said non-braking configuration to said braking configuration.

In drawing which illustrate example embodiments of the present invention,

Figure 1:
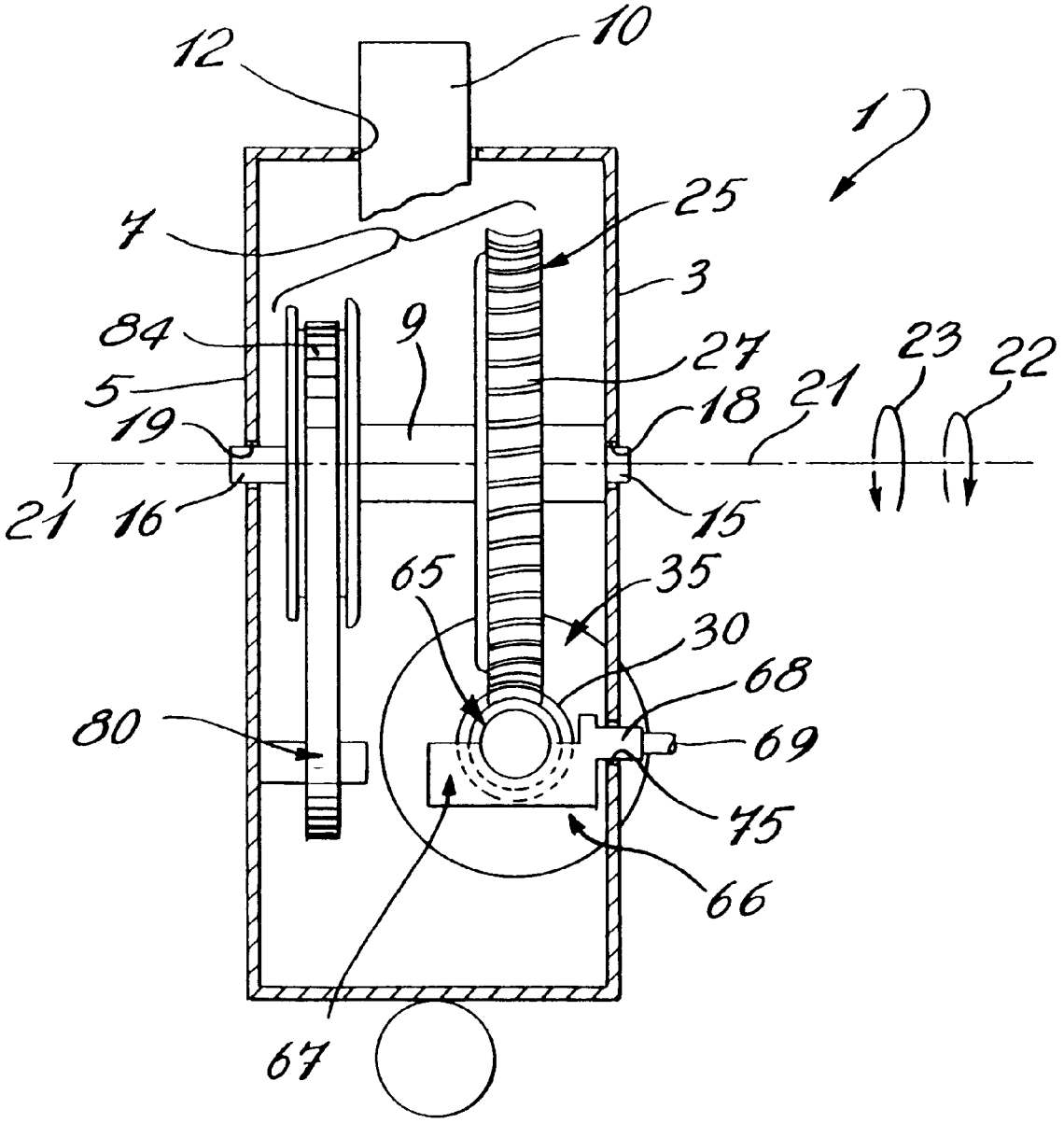
FIG. 1 is a schematic partial side view of an example winch assembly in accordance with the present invention wherein a narow side part of the support structure has been removed to expose components of the assembly.
Figure 2:
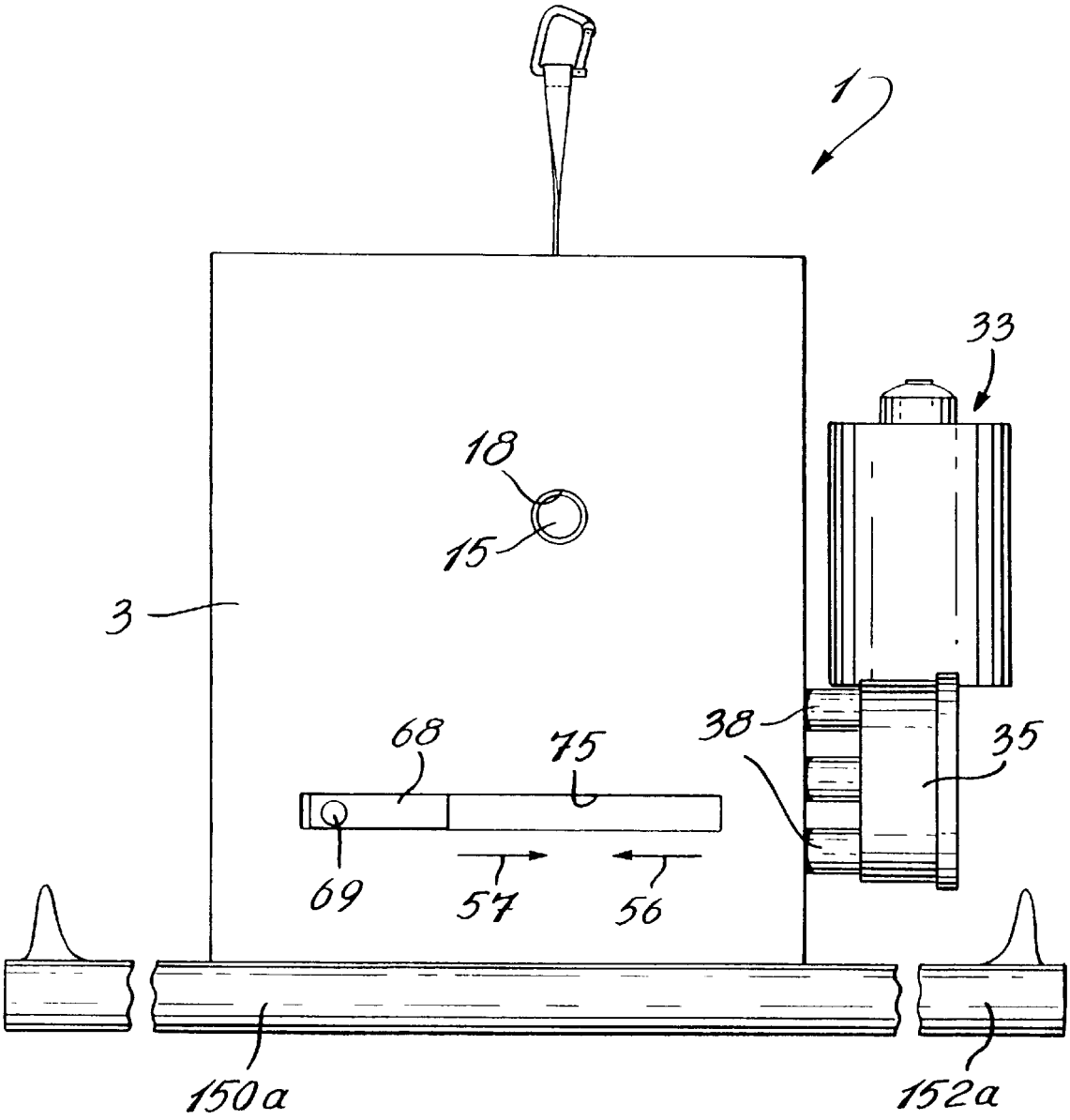
FIG. 2 is a schematic side view of the winch assembly of FIG. 1 showing a broad plate side thereof.
Figure 3:
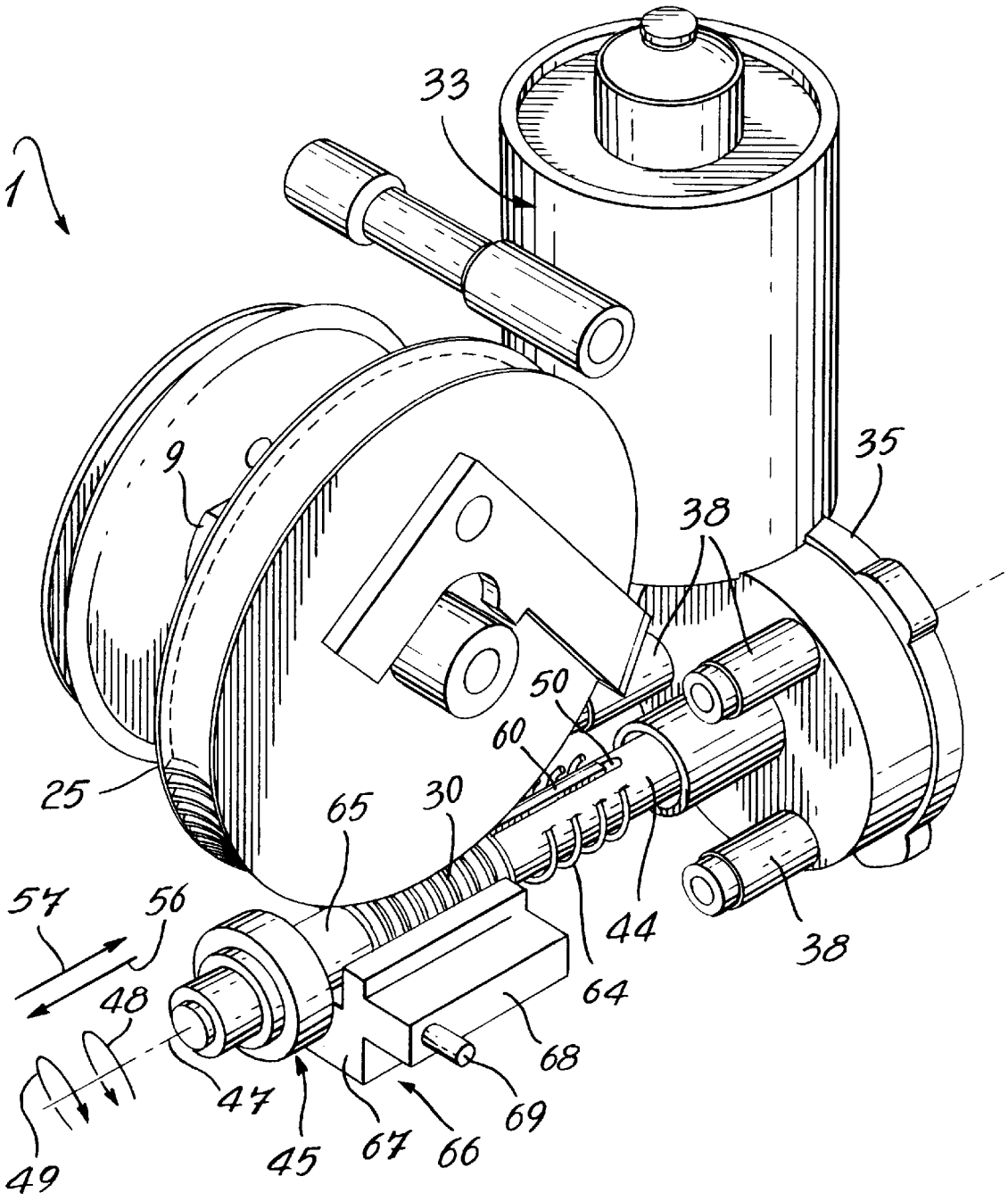
FIG. 3 is a schematic perspective side view of the winch assembly of FIG. 1 showing the broad plate side thereof as seen in FIG. 2 but wherein the support structure has been removed so as to expose components of the winch assembly, the worm drive gear being in a working position.
Figure 3A:
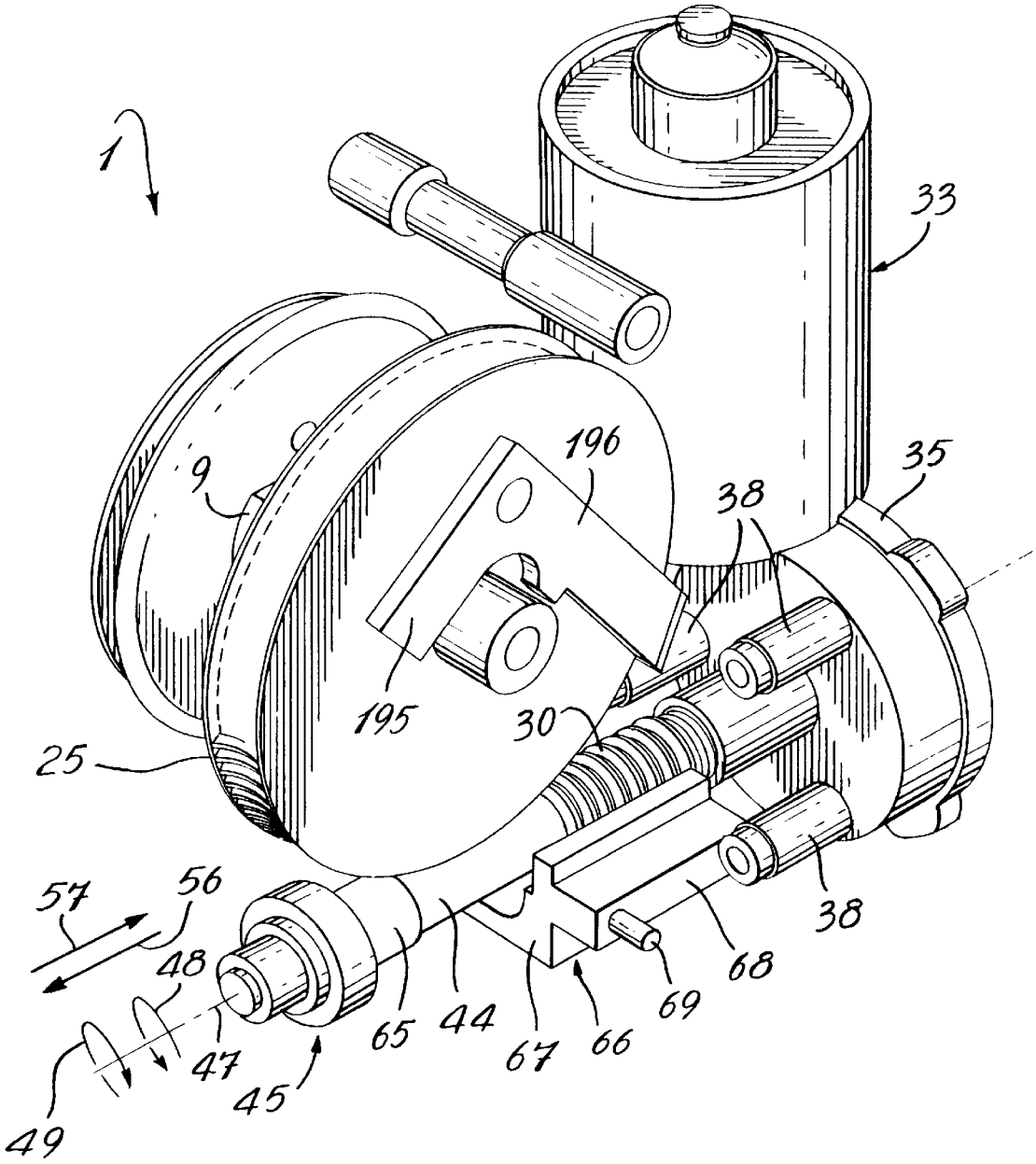
Figure 4:
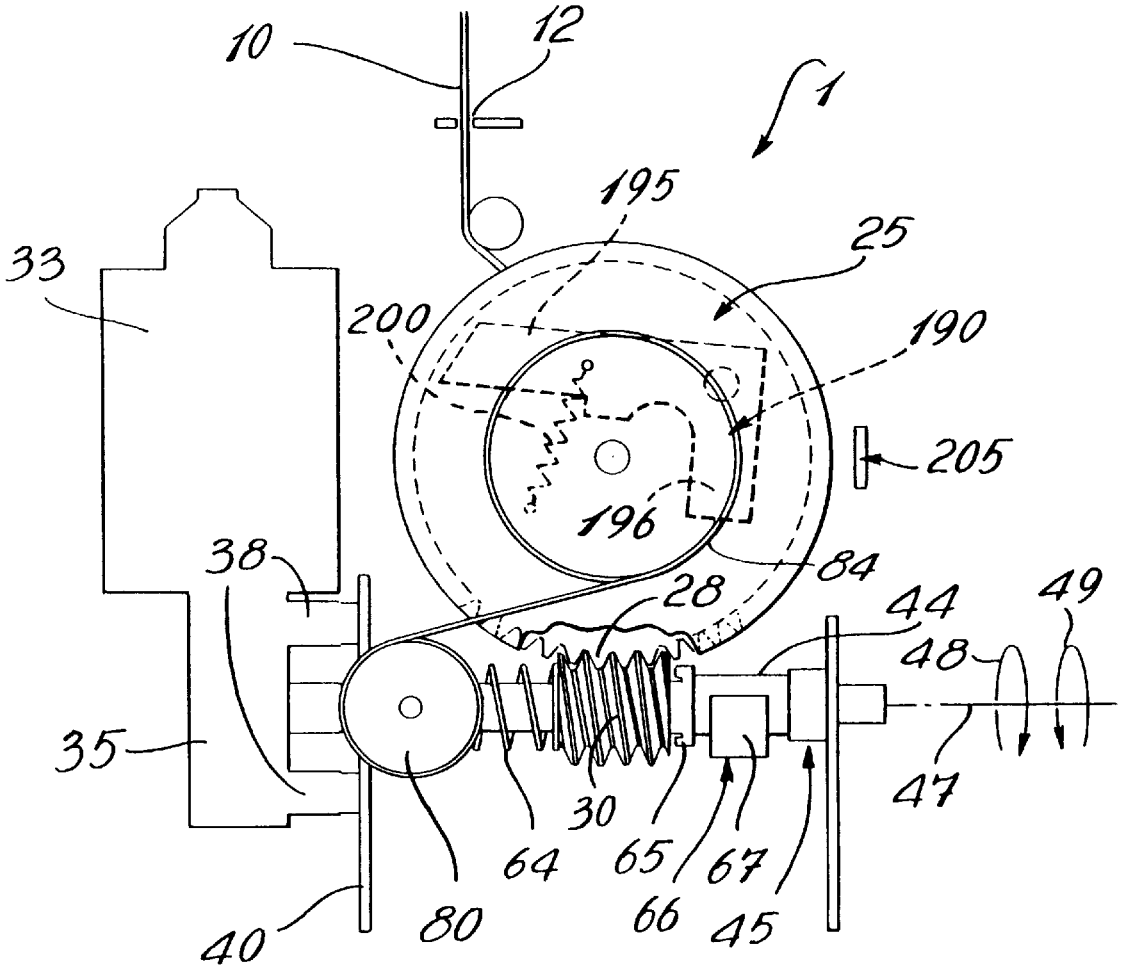
Figure 5:
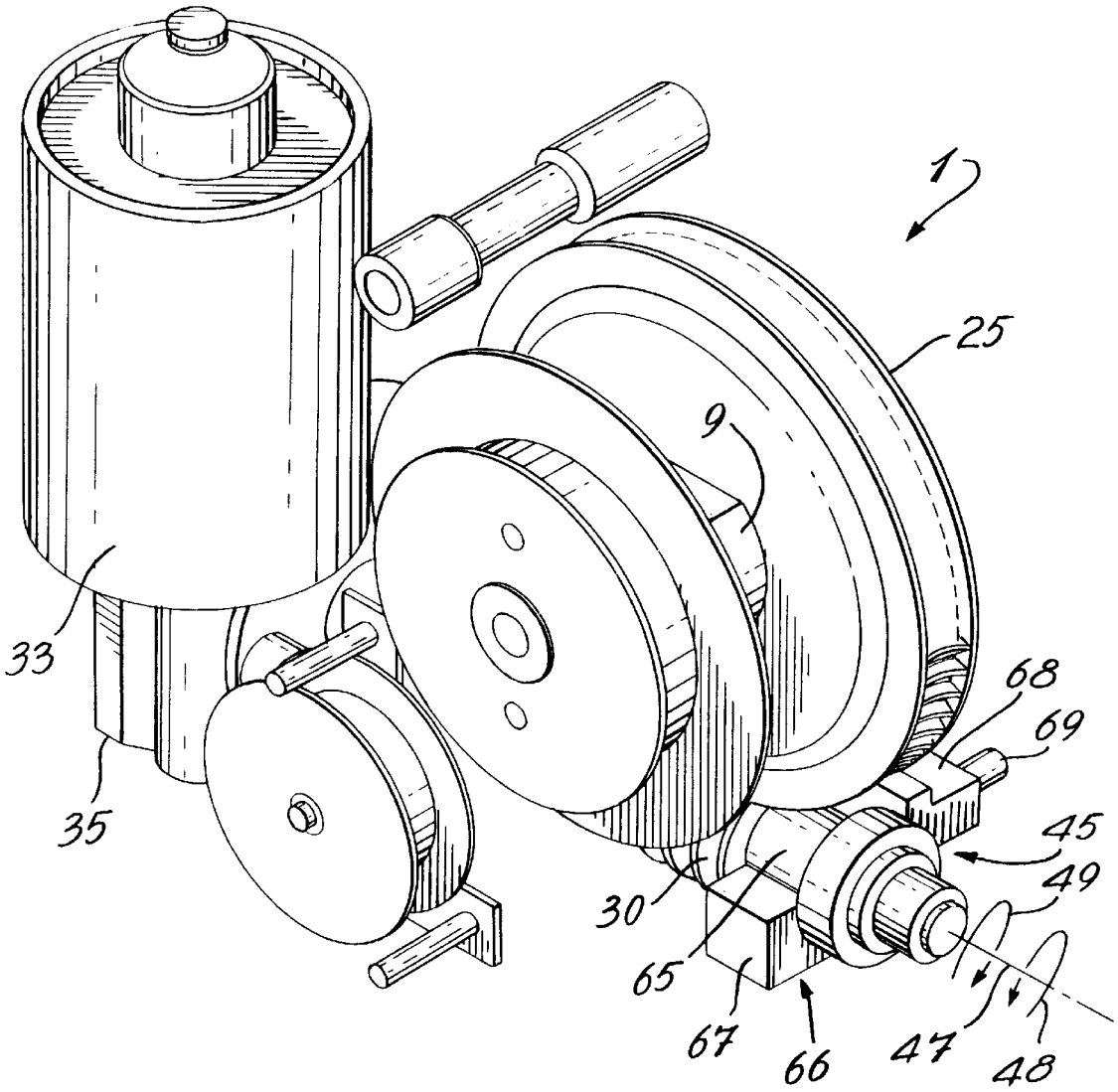
Figure 6:
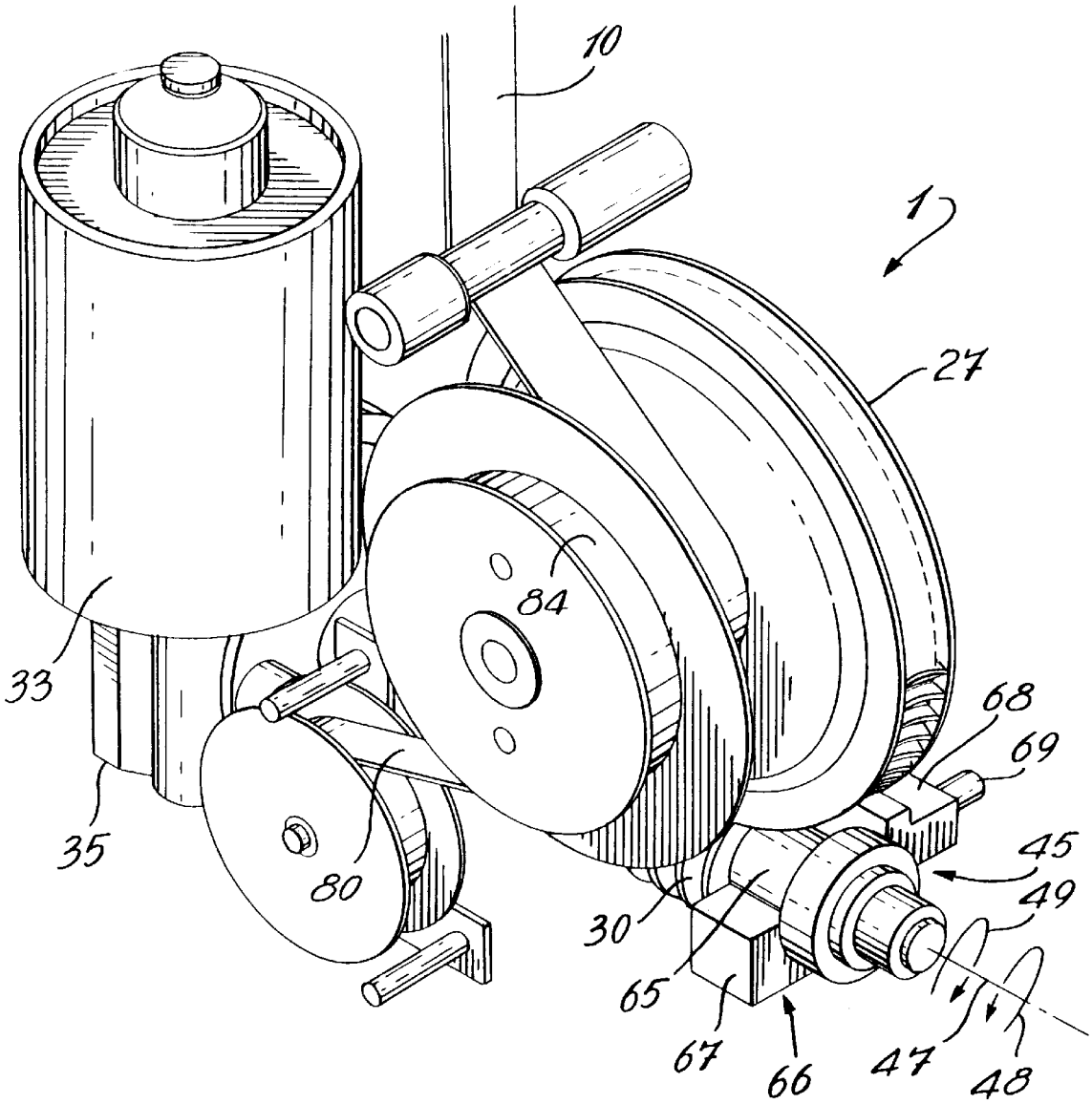
Figure 7:
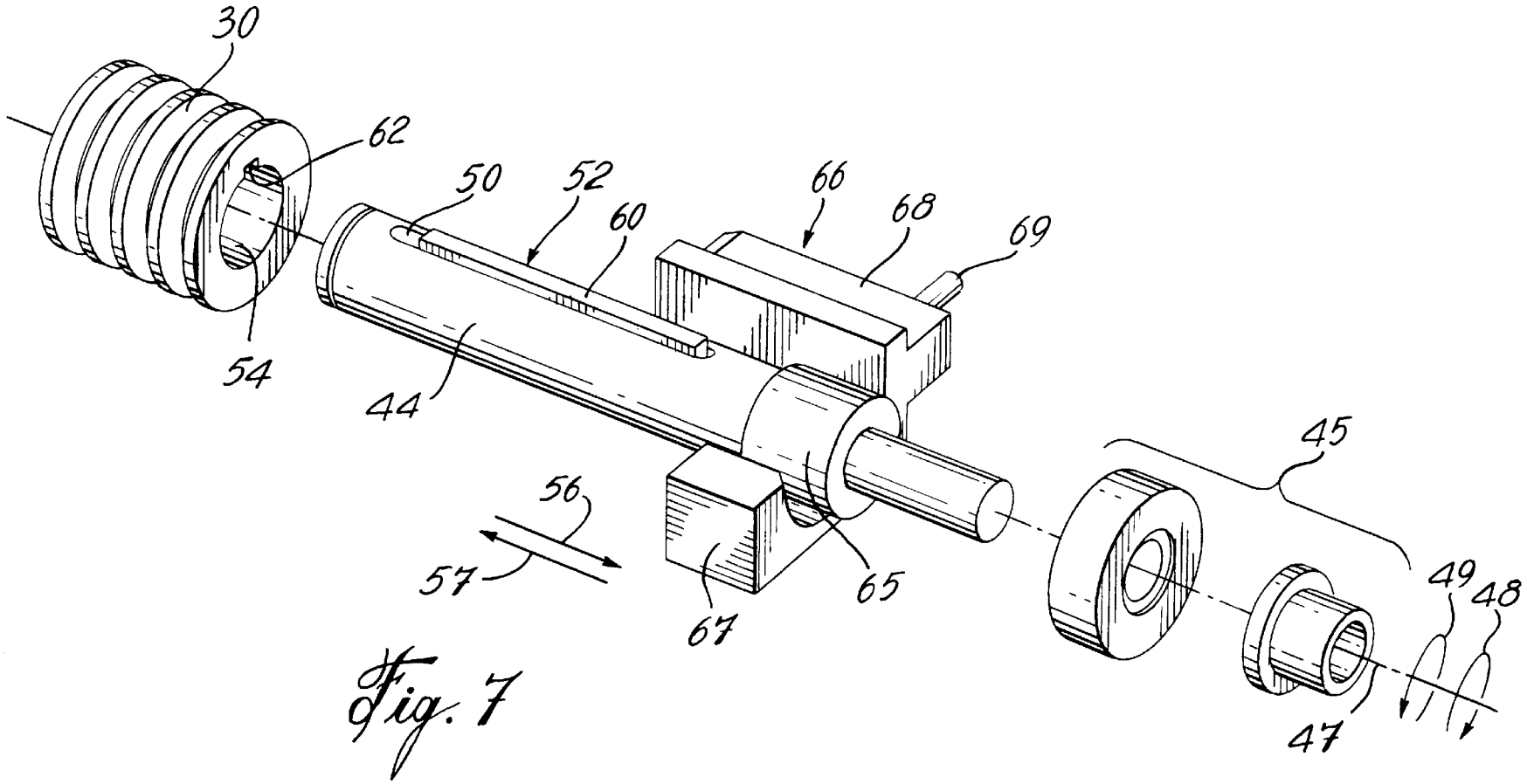
Figure 8:
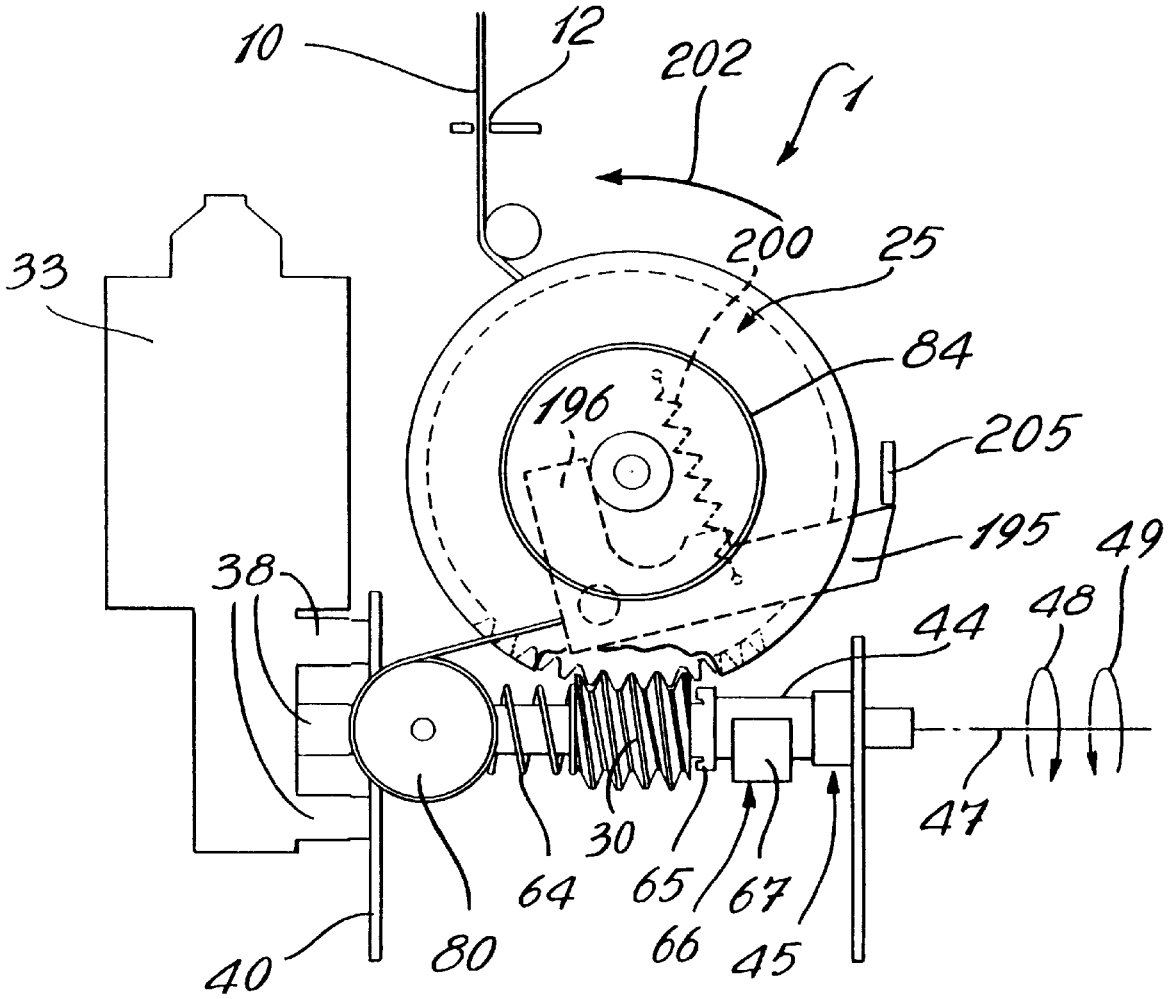
Figure 9:
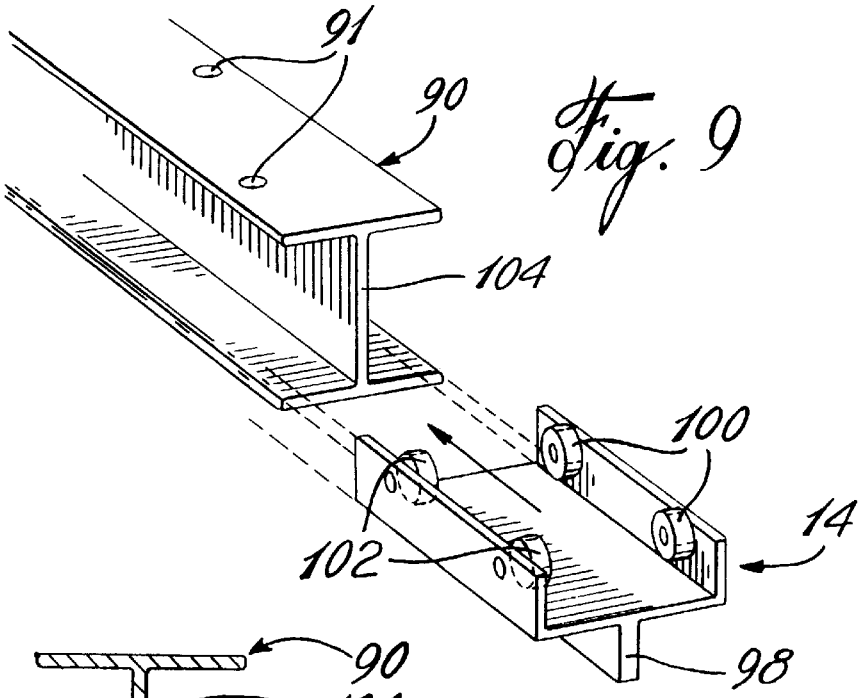
Figure 10:
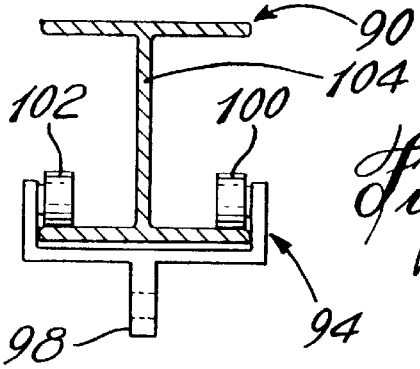
Figure 11:
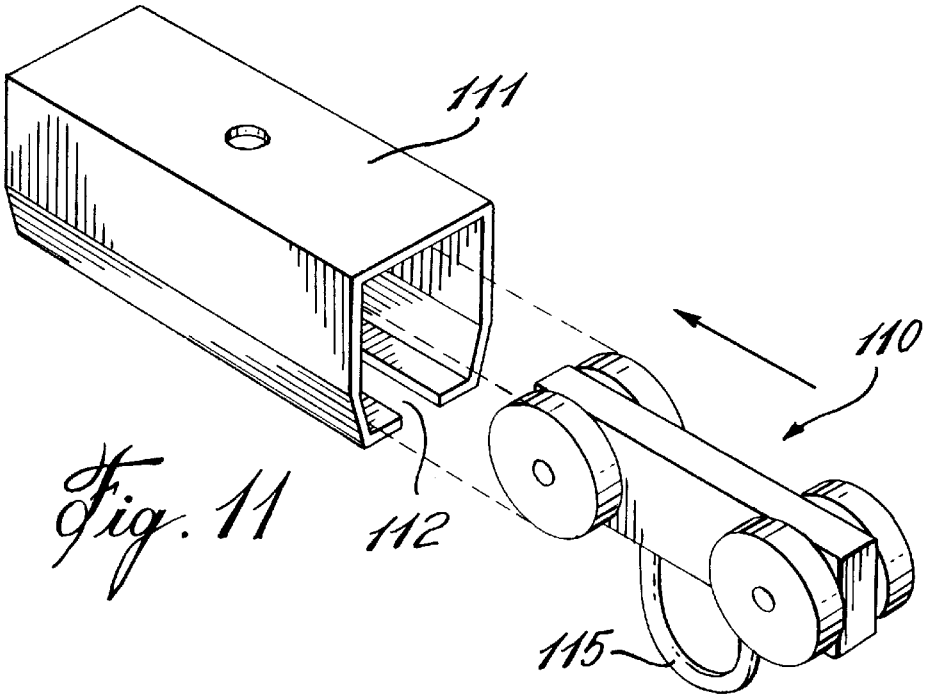
Figure 13:
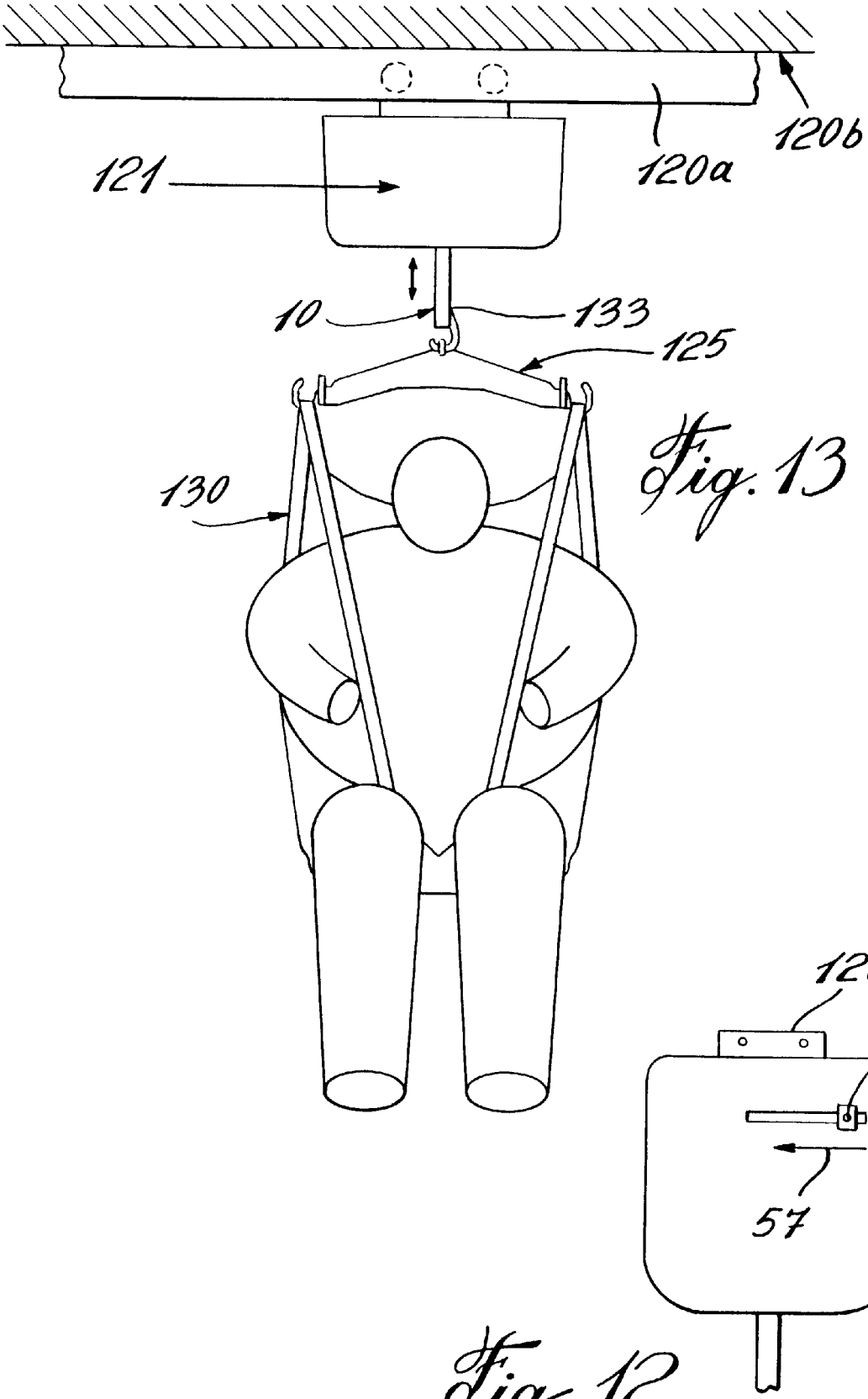
Figure 12:
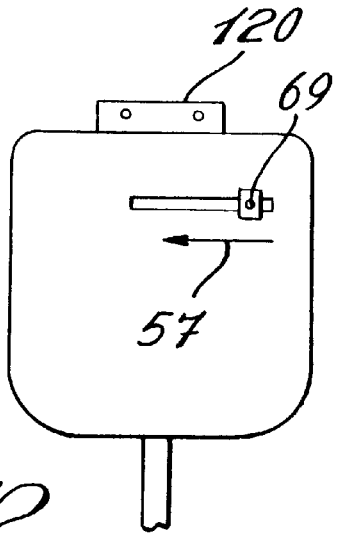
Figures 14, 15:
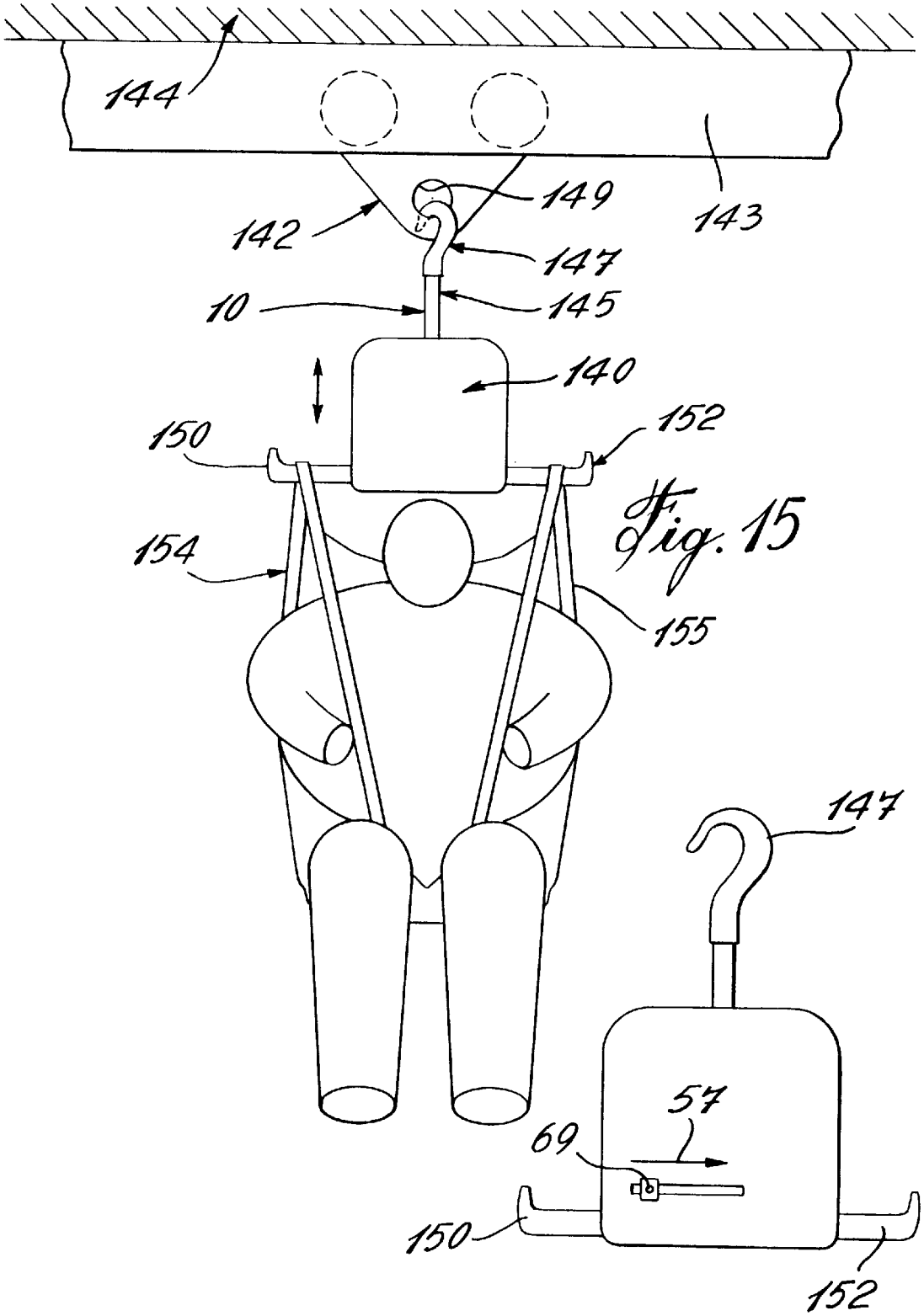
Figure 16:
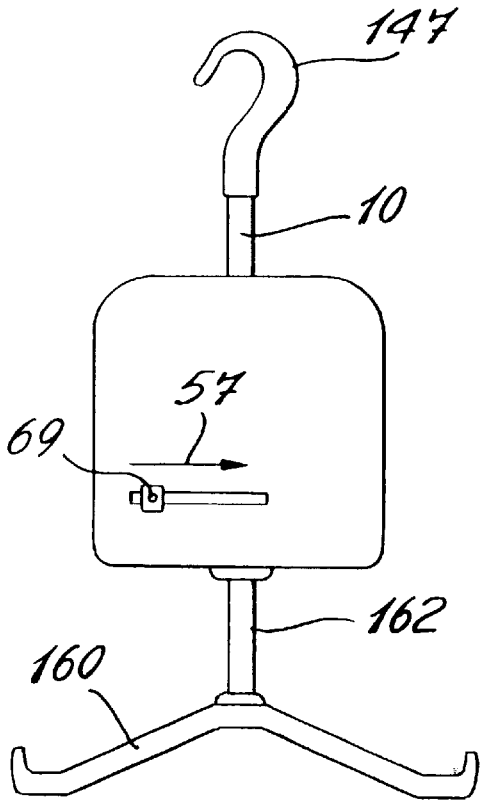
Figure 17:
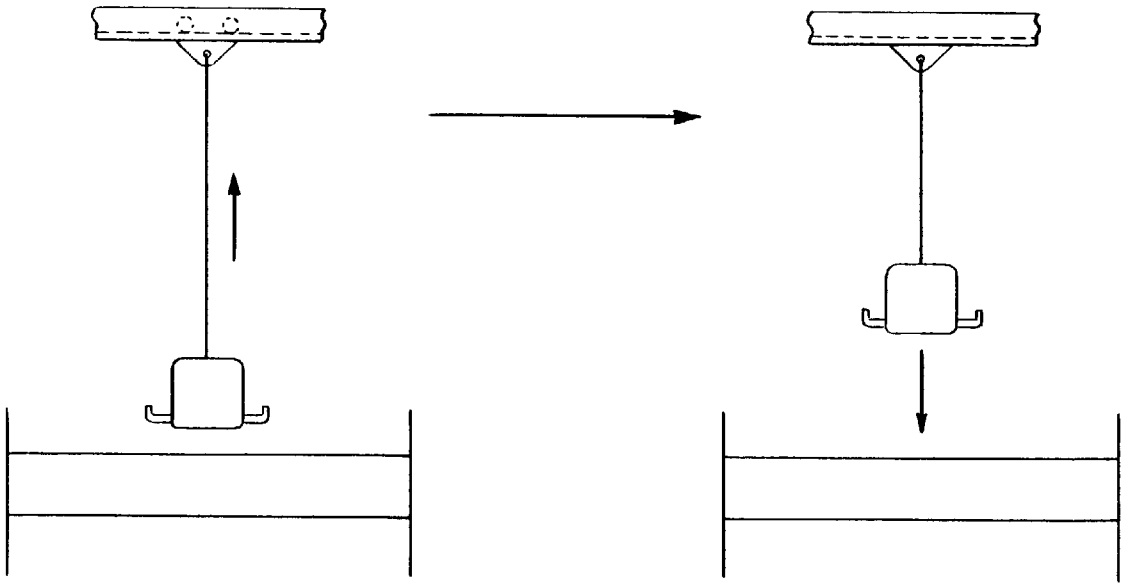
Figure 18:
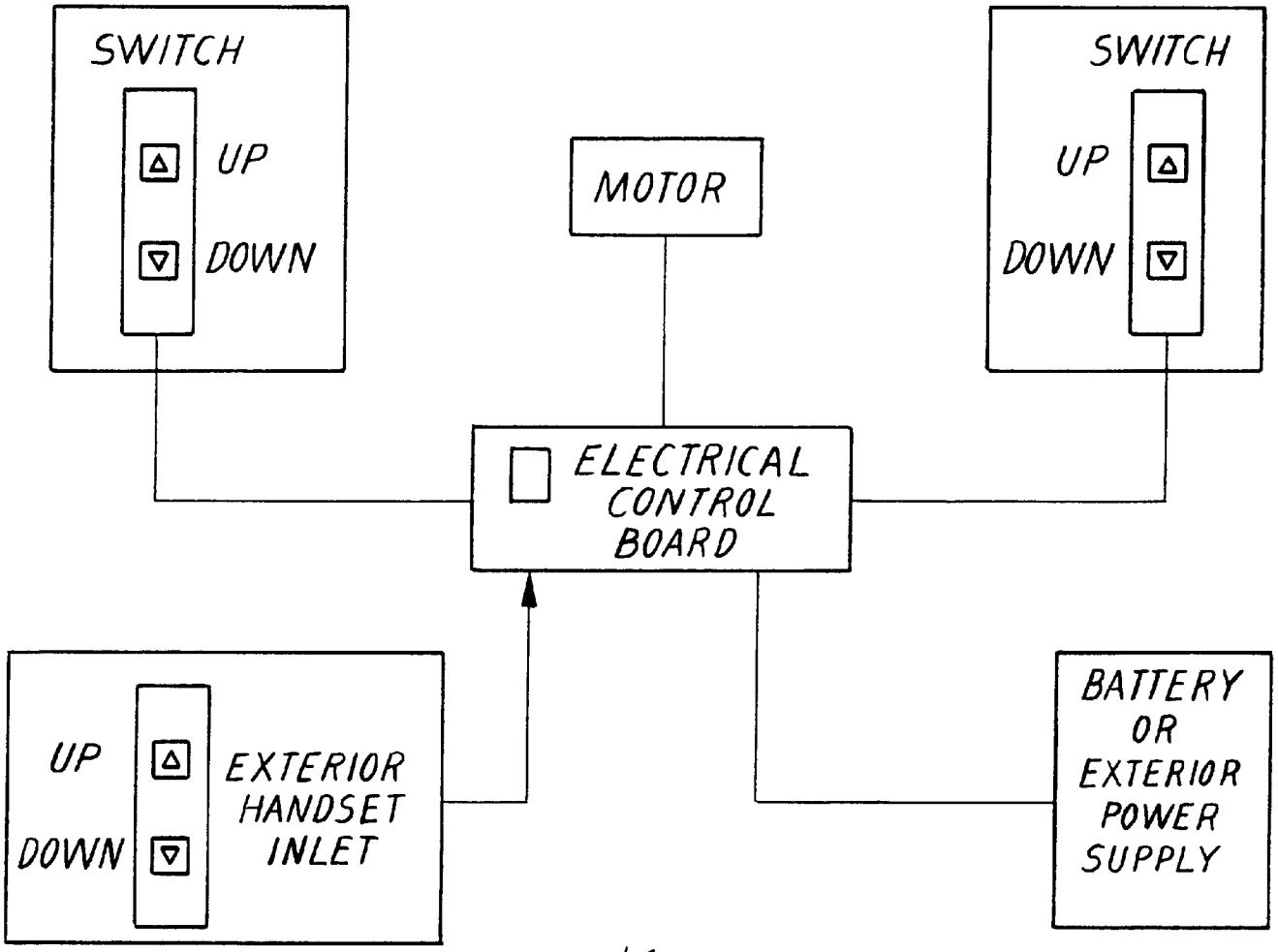
Figure 19:
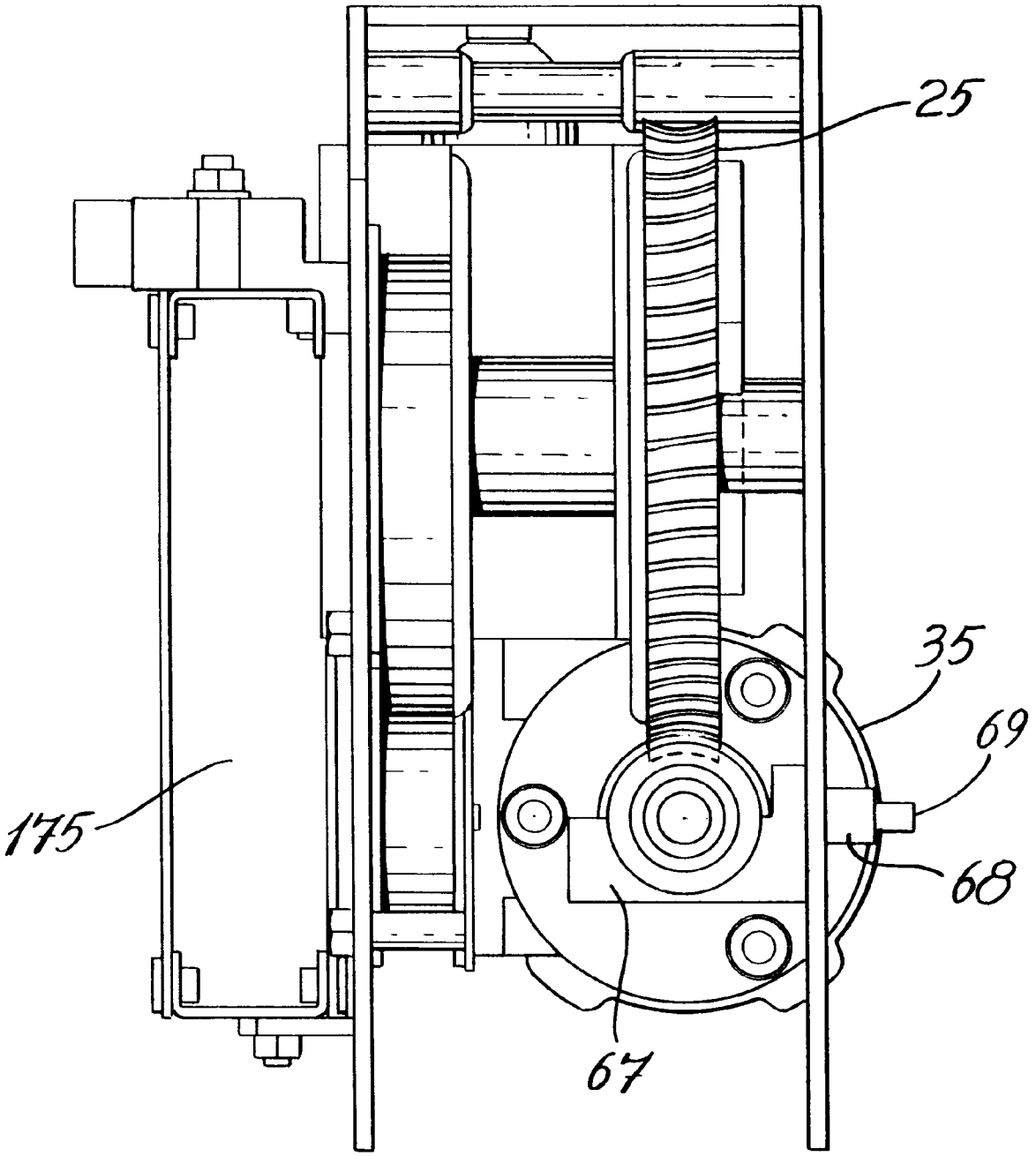

FIG. 3*a* is the same schematic perspective side view of the winch assembly of FIG. 1 as shown in FIG. 3 but wherein the worm drive gear is in a non-working position;

FIG. 4 is a schematic side view of the winch assembly of FIG. 1 showing the broad plate side thereof opposite to the broad plate side shown in FIG. 2 wherein the broad plate has been removed so as to expose components of the winch assembly;

FIG. 5 is a schematic perspective side view of the winch assembly of FIG. 1 showing the broad plate side thereof as seen in FIG. 4 but wherein the support structure has been removed so as to expose components of the winch assembly;

FIG. 6 is the schematic perspective side view as shown in FIG. 5 but including an elongated flexible support member and a spring rewind coil;

FIG. 7 is an exploded perspective side view showing the disposition of a worm gear displacement element of the winch assembly of FIG. 1 relative to the worm drive gear and worm drive gear shaft;

FIG. 8 is the same as FIG. 4 except that it illustrates the disposition of a centrifugal brake element in a working position to inhibit continued rotation of the reel component;

FIG. 9 illustrates an example trolley/track combination with the trolley being in the process of being installed on the I-beam like track;

FIG. 10 is a cross section view of the track shown in FIG. 9 with the trolley engaged therewith;

FIG. 11 illustrates another example trolley/track combination with the trolley being in the process of being installed on the tubular slotted track;

FIG. 12 illustrates an example winch assembly wherein the support structure has an outwardly extending projecting which may be attached or fixed to a downwardly extending carriage projection;

FIG. 13 is a schematic illustration of the exploitation of the winch assembly of FIG. 12 in a person handling system;

FIG. 14 illustrates another example winch assembly wherein the elongated flexible support member is provided with attachement means for attaching the elongated flexible support member to a downwardly extending carriage projection;

FIG. 15 is a schematic illustration of the exploitation of the winch assembly of FIG. 13 in a person handling system;

FIG. 16 illustrates a further example winch assembly wherein the elongated flexible support member is provided with attachement means for attaching the elongated flexible support member to a downwardly extending carriage projection and a support arm is flexibly attached to the support structure of the winch assembly;

FIG. 17 illustrates the action of a person handling system as shown in FIGS. 14 and 15 for transporting a person between beds, the person and the supporting harness being ommitted;

FIG. 18 illustrates in block diagram form example energisation elements for the electric motor of a winch assembly in accordance with the present invention; and FIG. 19 is a further schematic illustration of the winch assembly as seen in FIG. 1 but wherein a battery pack structure is attached to a broad side plates.

The example winch assembly 1 illustrated in the FIGS. 1 to 8 has a support structure which has a rectangular box like form. The support structure has two opposed major or broad plate sides 3 and 5. The support structure may for example be of aluminum with the various elements thereof being welded to each other.

The winch assembly 1 is provided with a reel component 7 having a cylindrical body 9 about which an flexible elongated support member 10 such as a cable, strap or the like may be wound or unwound; only a portion of the elongated member 10 is shown in FIG. 1 in order to expose the cylindrical body 9. As may be seen the elongated support member 10 extends through an opening 12 in the support structure.

The cylindrical body 9 is fixedly mounted on or to a rotatable reel drive shaft in any suitable manner. The opposite ends 15 and 16 of the rotable reel drive shaft are rotatably engaged in respective openings 18 and 19 in the plate sides 3 and 5 of the support structure, i.e. the shaft and the cylindrical body 9 attached to it are capable of being rotated about a longitudinal axis 21 in the direction of the arrow 22 or in the opposite direction of the arrow 23. In the absence of being coupled to a motor as described herein the cylindrical body is free to rotate in the above mentioned directions. Alternatively, if desired the opposite ends of the reel drive shaft may be journaled in suitable bearing means attached in any suitable manner to the plates 3 and 5.

The reel component 7 has an enlarged rim element 25. The periphery 27 has a concave form wherein are disposed peripheral worm gear teeth; one of the teeth is designated in FIG. 4 by the reference numeral 28—a portion of the side wall of the rim element 25 has been taken away so as to expose the tooth 28). The peripheral worm gear teeth are configured to mesh with a worm drive gear 30 in order to induce rotation of the reel component in the direction of either of the arrows 22 and 23 (i.e. for inducing the elongated member 10 to be paid out or unwound from or to be wound up about the cylindrical body thereof).

The winch assembly includes an electric motor 33 (i.e. a reversible motor) which is attached or coupled in any suitable known fashion to a speed reducing gearing means 35. The speed reducing gearing means 35 in turn is attached via attachement members designated by the reference numeral 38 to the support structure, (for example by a nut and bolt system which fixes the speed gearing means to a transverse plate 40 attached (e.g. welded) to one or both of the broad side plates).

The drive shaft of the motor is indirectly connected to one end of a worm gear drive shaft 44 through the speed reducing gearing means 35; if desired the speed reducing gearing means 35 may be ommitted and the shaft of a suitable motor may be directly connected to the worm gear drive shaft 44 which may simply be an extension of the motor drive shaft.

The other end of the worm gear drive shaft 44 is journaled in a bearing means 45 which is also attached in any suitable known manner to the support structure.

The worm gear drive shaft 44 has a longitudinal rotational axis 47 about which the worm gear drive shaft 44 is able to rotate in the opposite directions indicated by the arrows 48 and 49.

Referring to FIG. 7 the worm gear drive shaft 44 also has a slot 50 for receiving in press fit fashion a key element 52. The key element 52 is configured such that on the one hand it fixes the worm drive gear 30 to the worm gear drive shaft 44 such that rotation of the worm gear drive shaft 44 induces the same rotation of the worm drive gear 30 and on the other hand the worm drive gear 30 has a longitudinal freedom of movement.

The worm drive gear 30 has a longitudinal opening 54 which is sized and configured such that the worm drive gear 30 may engage the worm gear drive shaft 44 such that worm drive gear is slidably displaceable in the direction of the arrows 56 and 57, i.e. the worm drive gear is longitudinally displaceable along the longitudinal rotational axis 47 of the worm gear drive shaft 44. The worm drive gear 30, however, is inhibited from rotating about the worm gear drive shaft 44 by the presence of the key element 52.

In the embodiment shown the key element 52 is a separate member which engages both the worm gear drive shaft 44 and the worm drive gear 30 such that rotation of the worm gear drive shaft 44 about the axis 47 induces a like rotation of the worm drive gear 30.

The key element 52 has a root member which is press fitted or engaged in the above mentioned slot 50 in the worm gear drive shaft 44. The head portion 60 of the key element 52 not engaged in the slot 50 of the worm gear drive shaft 44 is sized and configured to be slidably engaged in a slot 62 in the inner wall defining the opening 54 of the worm drive gear 30 such that the worm drive gear 30 is displaceable along the longitudinal rotational axis as mentioned above, i.e. in the directions of the arrows 56 and 57.

If desired the key element 52 may be an integral part of either the worm gear drive shaft 44 or the inner side wall defining the opening 54 of the worm drive gear 30, i.e. the root of the key element 52 in this case may be integral with the body of the worm gear drive shaft 44 or of the worm drive gear 30 and the head portion thereof may be slidably engaged in a slot defined either in the drive shaft 44 or in the inner side wall of the opening 54 as the case may be. In any event the head portion of the key element and the slot in which the head portion is to be engaged are configured keeping in mind that the worm drive gear is to be longitudinally displaceable between a working (see FIG. 3) and non-working position (see FIG. 3*a*).

As shown in FIG. 3 the worm drive gear 30 is in a working position wherein it engages or meshes with the peripheral worm gear teeth of the rim element 25.

The worm drive gear 30 is biased or maintained in the working position by the cooperative action of a spring bias element 64 (only a portion of which is shown in FIG. 3) and a shoulder stop member 65 provided on the worm gear drive shaft 44 (see FIG. 7). The shoulder stop member 65 is configured and sized such that it is larger than the opening 54 so that the worm drive gear 30 cannot pass over the shoulder stop member 65. The spring bias element 64 on the one hand abuts the support structure (directly or indirectly) and on the other hand abuts one side of the worm drive gear 30 so as to bias the worm drive gear 30 up against the shoulder stop member 65. The shoulder stop member 65 is disposed such that the spring biasing element 64 is not able to force the worm drive gear beyond the working position. The spring bias element 64 may be under some compression as it tends to maintain the worm gear in the working position. The biasing force of the spring biasing element 64 is of course to be sufficient so as to be able to maintain the worm drive gear 30 in the working position while the worm gear drive shaft 44 is being rotated by the energised motor 33. Any other type of biasing system may of course be used for biasing the worm drive gear 30 in the working position.

The assembly also has a worm gear displacement element 66. The worm gear displacement element 66 has an abutment body 67, a slot engaging or runner member 68 and a tab member 69. The abutment body 67 as may be seen in the figures (see FIGS. 4, 5 6 and 8) is disposed between the worm drive gear 30 and the bearing means 45 of the worm gear drive shaft 44. In the example embodiment shown the abutment body 67 is sized relative to the shoulder stop member 65 such that when the worm gear drive 30 abuts the shoulder stop member 65 the abutment body 67 may be spaced away from the worm drive gear 30 a relatively small distance.

The worm gear displacement element 66 is configured so as to have a longitudinal freedom of movement in the direction of the arrows 56 and 57 (see FIG. 2, 3, 3*a* and 7). The abutment body 67 may take any suitable form or configuration for this purpose. The abutment body 67 is configured such that it may be manually pushed longitudinally along the longitudinal axis 47 of the worm gear drive shaft 44 so as to be able to abut the side of the worm drive gear 30 opposite to that which is abutted by the spring bias element 64. As shown the abutment body 67 has a fork like cross section. The space between the prongs of the abutment body 67 is larger than the outer diameter of the shoulder stop member 65 so as to allow for the longitudinal movement mentioned above but smaller than the outer diameter of the worm drive gear 30 so as to allow the abutment body 67 to engage the worm drive gear 30 for urging it from the working position (see FIG. 3) to the non-working position shown in FIG. 3*a*.

The side plate 5 of the support structure has a longitudinal slot 75. The slot engaging or runner member 68 is slidably engaged in the slot 75 such that the tab member 69 is on the opposite side of the plate 5 relative to the abutment body 67. The slot 75 is configured and disposed such that the tab member 69 may be manually manipulated for displacing the worm drive gear 30, (against the biasing action of the spring bias element 64), from the working position shown in FIG. 3 to a non working position as shown in FIG. 3*a*. As may be understood this displacement to the non-working position may be achieved by pushing the tab member 69 in the direction of the arrow 57. The tab member 69 is pushed with sufficient force so as to induce the abutement member 67 to push against the worm drive gear 30 so as to compress the spring biasing element 64 while bring the worm drive gear 30 to the non-working position shown in FIG. 3*a*. When the tab 69 is released the spring biasing element 64 will tend to push the worm drive gear 30 back to the working position. As mentioned above, the de-coupling and coupling is carried out with the motor being de-energised, i.e. no electrical power is being delivered to the motor so its shaft is not turning.

Since the there component is freely rotatable in the direction of the arrows 22 and 23 de-coupling may induce the reel component to rotate a certain degree before the worm drive gear 30 is in the non-working position wherein the peripheral worm gear teeth of the rim element 25 are no longer meshed with the worm drive gear 30.

If desired the winch assembly may be provided with a mechanism tending to urge the rewinding of an elongated flexible support member 10 onto the reel component. Various rewind mechanisms are known. An example of this type of mechanism is illustrated in FIGS. 1 to 8 wherein a spring coil 80 is wound about a rotatable drum and has a free end 84 which is attached to another drum which is fixed to the reel component drive shaft. The free end is fixed to the other drum such that the when a force is applied to the elongated flexible support member 10 to unwind it from the reel component the spring coil 80 is induced to unwind form it a drum and wind about the other drum; once the unwinding force is removed the spring coil 80 tends to rewind about its own drum and in turn rewinds the elongated flexible support member 10 onto the reel component.

Referring to FIGS. 9 to 16 a winch assembly as described hereinabove above may be incorporated into a patient or person handling system in accordance with the present invention, i.e. a system for lifting, lowering and transporting a person. The person handling system comprises a trolley component and an overhead track or rail component for guiding the trolley along a predetermined path. A trolley component may take on any suitable form which allows it to be supported by and glide along a track component, i.e. such that a trolley component may be moved manually along the track or may be so moved by providing a suitable motorised trolley displacement system.

An example of a manually operated trolley/track patient handling combination is illustrated in the FIGS. 9 and 10. The track component comprising a track 90 having has an I-beam like cross section; the track is attached to a ceiling (not shown) in any suitable way (e.g. by a fastener system comprising screws, nails, nuts/bolts etc. which may engage openings like openings 91). The trolley component may comprise a wheeled carriage 94 having a downwardly extending projection 98 for attachment to a winch assembly. The carriage 94 also comprises two pairs of opposed wheels 100 and 102. The pairs of wheels are disposed on opposite sides of a central web 104 of the track component 90. Each pair of wheels is supported on a respective lip projecting more or less horizontally from the web. The trolley component once installed onto the track may be displaced or rolled manually about the track component.

An alternate trolley/track combination is shown in the FIG. 11. For this version the trolley component 110 is similar to that described above. The track component however, comprises a hollow tubing 111 provided with a centrally disposed longitudinally extending lower slot 112 through which may project a downwardly extending carriage projection 115 for attachment to a winch assembly. The trolley component 110 for this version may also be displaced or rolled manually about the track component.

It is of course to be understood that any other type of trolley/track combination may be used. The carriage for example need not be wheeled, i.e. it may comprise sliding members of a more or less frictionless material such as of TEFLON.

A winch assembly in accordance with the present invention may if desired be attached to an above mentioned downwardly extending carriage projection such that the body of the winch assembly is not upwardly and downwardly displaceable. Referring to the FIGS. 12 and 13, the support structure of a winch assembly may for example have outwardly extending projecting 120 which may be fixed to a downwardly extending carriage projection in any suitable releasable (e.g. by a nut/bolt attachment system) or permanent (e.g. welding) manner; the trolley is shown as being engaged in a track 120*a* attached to a ceiling 120*b*. Referring to FIG. 13 in this case the elongated member 10 alone may be unwound downwardly away from the main body 121 of the winch assembly which is more or less fixed in place. The free end 123 of the elongated member 10 may be releasably or permanently attached to a support arm component 125 for releasable engagement with a patient carrying harness or sling indicated generally by the reference numeral 130; a person is shown in general outline as being held in the harness. The free end 123 may be provided for example with an attachment element for releasable attachment of the elongated element to the patient harness or sling. In this case the free end of the elongated member may for example be attached to a support arm component 125 by a hook/eyelet combination (see FIG. 15); e.g. the free end of the elongated member may be provided with a hook and the support arm with an eyelet for releasable engagement with the hook or vice-versa.

Alternatively, referring to FIGS. 14 and 15, a winch assembly in accordance with the present invention may if desired be attached to an above mentioned downwardly extending carriage projection such that the body 140 of the winch assembly is upwardly and downwardly displaceable. In this case, the elongated member 10 of a winch assembly may be attached to a downwardly extending carriage projection 142 in any suitable releasable (e.g. by a nut/bolt attachment system) or permanent fashion; the trolley is engaged in a track 143 which is attached to the ceiling 144. For example, in this case the free end 145 of the elongated member 10 may be attached to the downwardly extending carriage projection 142 by a hook/eyelet combination as described above, i.e. by hook 147 and eyelet 149. In this case a winch assembly as seen in the FIG. 14 may itself include a support arm component for releasable engagement with a patient carrying harness or sling. The support arm component may comprise a pair of opposed support arm elements 150 and 152 fixed to the support structure of the winch assembly on opposite sides thereof, each support arm element being able to releasably engage a respective portion of a patient harness (see also support arm elements 150*a* and 152*a* in FIG. 2). In the case shown the harness support straps 154 and 155 are each releasably wrapped or hung over a respective support arm element.

Alternatively when the winch body is able to be displaced upwardly and downwardly, a separate support arm 160 such as is shown in the FIG. 16 may be attached to the winch assembly by a length of flexible strap 162 in any suitable fashion such as mentioned above.

As may be appreciated from the above the winch assemblies of FIGS. 14 and 16 may be of portable configuration such that they may be transfered between patient stations provided with suitable trolley/track combinations; i.e. only this element of the handling system need be transfered between patient stations.

FIG. 17 illustrates the use of a handling system as shown in FIGS. 14 and 15 for transfering a persons in the direction of the arrows from one bed to another (the person/harness not being shown). When initially attaching the person to the harness the motor is de-coupled as described above such that the winch assembly body may be manually relatively quickly lowered into a position for attachment of the person/harness combination to the winch assembly support arms. Thereafter the tab member 69 is released to recouple the motor and reel component. With the person in place the motor is energised for lifting the person upwards; the person is displaced over the other bed by being pushed along the track; the motor is energised for lowering the person onto the other bed, i.e. by reversing the direction of rotation of the motor.

The motor may be electrically energised in any suitable fashion e.g. through the use of a suitable on/off switch(s) and electric wiring connecting the motor to suitable source of electric power. The source of electric power may be one or more batteries if it is desired to provide the assembly with a certain degree of autonomy; alternatively the source of electrical power may be an electrical outlet of a conventional power grid to which the motor may be electrically connected in any known suitable fashion. The use of batteries is advantageous in that a patient handling system in accordance with the present invention would not need to include in the basic installation electrical wiring. Referring to FIG. 18, this figure shows an example in block diagram form of a possible electrical setup for energising a motor (reversible) for lifting and lowering a person; as may be seen the setup included switch mechanisms for the raising and lowering of a person, i.e. for reversing the rotation of the reversible motor. The electrical control board may be incorporated into the winch assembly along with appropriate switchs (and if desired batteries). FIG. 19 shows an example winch assembly with a battery holder 175 attached to a broad side wall thereof.

If desired a winch assembly may include a braking mechanism such as centrifugally activated brake. An example of such centrifugal brake is shown in FIGS. 1 to 8. The brake includes a brake body 190 which is pivotally attached to the drum about which the free end of the rewind coil is attached (see above); the pivot attachement point 192 is offset relative to the rotation axis of the above mentioned drum. The brake has two arm components 195 and 196. The non-working position is shown in FIG. 4. The brake is maintained in this position by a spring member 200. The brake is centrifugally activatable in that if the rotation of the reel means in the direction of the arrow 202 is too fast the arm component 195 will be thrown outward so as to eventually engage the brake stop 205 while the other arm component 195 will abut the reel component drive shaft so as to impede further rotation of the reel component; this working position is shown in FIG. 8. This type of braking system may be used as a safeguard to prevent a too fast descent of a person due to some event (e.g. a breakdown of the motor).

We claim:

1. A person handling system comprising a) an overhead track component comprising a track b) a trolley component comprising a carriage and c) a person lowering and raising winch assembly connected to said carriage said overhead track component and said trolley component being configured such that said carriage engages said track such that said carriage is able to glide along said track, said person lowering and raising winch assembly comprising a support structure a worm drive gear, an electric motor connected to said worm drive gear for urging the worm drive gear to rotate, said worm drive gear, when said motor is in a non-energised state, being displaceable between a working position and a non-working position, a flexible elongated support member connected to a reel component for unwinding and winding up said flexible elongated support member, said reel component being connected to said support structure gear means coupled to said reel component for urging said reel component to rotate, said gear means being provided with a plurality of peripheral worm gear teeth configured to mesh with and be driven by the worm drive gear, a spring element biassing the worm drive gear in said working position, a worm gear displacement component for releasably displacing said worm drive gear from said working position to said non-working position and wherein when the worm drive gear is in said working position, the worm drive gear engages said worm gear teeth for rotation of said reel component when said electric motor is in an energised state and wherein when said worm drive gear is in said non-working position the worm drive gear is disengaged from said worm gear teeth and the flexible elongated support member is able to be manually unwound from the reel component.

2. A person handling system as defined in claim 1 comprising a harness component for holding a person, and wherein said support structure of the winch assembly is connected to the carriage and said flexible elongated support member is connected to said harness component.

3. A person handling system as defined in claim 1 comprising a harness component for holding a person, and wherein the flexible elongated support member of the winch assembly is connected to the carriage and said support structure of the winch assembly is connected to said harness component.

4. A person handling system as defined in claim 1 comprising braking means for braking the unwinding of the flexible elongated support member from the reel component.

5. A person handling system as defined in claim 1 comprising a braking component for braking the unwinding of the flexible elongated support member from the reel component and wherein said braking component and said reel component are configured such that said braking component is attached to said reel component so as to have a braking configuration and a non-braking configuration and such that said braking component is able to be centrifugally displaced from said non-braking configuration to said braking configuration.

6. A person lowering and raising winch assembly comprising a support structure a worm drive gear, an electric motor connected to said worm drive gear for urging the worm drive gear to rotate, said worm drive gear, when said motor is in a non-energised state, being displaceable between a working position and a non-working position, a flexible elongated support member connected to a reel component for unwinding and winding up said flexible elongated support member, said reel component being connected to said support structure, gear means coupled to said reel component for urging said reel component to rotate, said gear means being provided with a plurality of peripheral worm gear teeth configured to mesh with and be driven by the worm drive gear, a spring element biassing the worm drive gear in said working position, a worm gear displacement component for releasably displacing said worm drive gear from said working position to said non-working position and wherein when the worm drive gear is in said working position, the worm drive gear engages said worm gear teeth for rotation of said reel component when said electric motor is in an energised state and wherein when said worm drive gear is in said non-working position the worm drive gear is disengaged from said worm gear teeth and the flexible elongated support member is able to be manually unwound from the reel component.

7. A person lowering and raising winch assembly as defined in claim 6 comprising braking means for braking the unwinding of the flexible elongated support member from the reel component.

8. A person lowering and raising winch assembly as defined in claim 6 comprising a braking component for braking the unwinding of the flexible elongated support member from the reel component and wherein said braking component and said reel component are configured such that said braking component is attached to said reel component so as to have a braking configuration and a non-braking configuration and such that said braking component is able to be centrifugally displaced from said non-braking configuration to said braking configuration.

9. A person lowering and raising winch assembly comprising a support structure a worm drive gear, an electric motor connected to said worm drive gear for urging the worm drive gear to rotate, said worm drive gear, when said motor is in a non-energised state, being displaceable between a working position and a non-working position, a flexible elongated support member connected to a reel component for unwinding and winding up said flexible elongated support member, said reel component being connected to said support structure, said reel component having a rim element provided with a plurality of peripheral worm gear teeth configured to mesh with and be driven by the worm drive gear, a spring element biassing the worm drive gear in said working position, a worm gear displacement component for releasably displacing said worm drive gear from said working position to said non-working position and wherein when the worm drive gear is in said working position, the worm drive gear engages said worm gear teeth for rotation of said reel component when said electric motor is in an energised state and wherein when said worm drive gear is in said non-working position the worm drive gear is disengaged from said worm gear teeth and the flexible elongated support member is able to be manually unwound from the reel component.

10. A person handling system as defined in claim 9 comprising a harness component for holding a person, and wherein the flexible elongated support member of the winch assembly is connected to the carriage and said support structure of the winch assembly is connected to said harness component.

11. A person lowering and raising winch assembly as defined in claim 9 comprising braking means for braking the unwinding of the flexible elongated support member from the reel component.

12. A person lowering and raising winch assembly as defined in claim 9 comprising a braking component for braking the unwinding of the flexible elongated support member from the reel component and wherein said braking component and said reel component are configured such that said braking component is attached to said reel component so as to have a braking configuration and a non-braking configuration and such that said braking component is able to be centrifugally displaced from said non-braking configuration to said braking configuration.

13. A person handling system comprising a) an overhead track component comprising a track b) a trolley component comprising a carriage and c) a person lowering and raising winch assembly connected to said carriage, said overhead track component and said trolley component being configured such that said carriage engages said track such that said carriage is able to glide along said track person lowering and raising winch assembly comprising a support structure a worm drive gear, an electric motor connected to said worm drive gear for urging the worm drive gear to rotate, said worm drive gear, when said motor is in a non-energised state, being displaceable between a working position and a non-working position, a flexible elongated support member connected to a reel component for unwinding and winding up said flexible elongated support member, said reel component being connected to said support structure, said reel component having a rim element provided with a plurality of peripheral worm gear teeth configured to mesh with and be driven by the worm drive gear, a spring element biassing the worm drive gear in said working position, a worm gear displacement component for releasably displacing said worm drive gear from said working position to said non-working position and wherein when the worm drive gear is in said working position, the worm drive gear engages said worm gear teeth for rotation of said reel component when said electric motor is in an energised state and wherein when said worm drive gear is in said non-working position the worm drive gear is disengaged from said worm gear teeth and the flexible elongated support member is able to be manually unwound from the reel component.

14. A person handling system as defined in claim 13 comprising a harness component for holding a person, and wherein said support structure of the winch assembly is connected to the carriage and said flexible elongated support member is connected to said harness component.

15. A person handling system as defined in claim 13 comprising braking means for braking the unwinding of the flexible elongated support member from the reel component.

16. A person handling system as defined in claim 13 comprising a braking component for braking the unwinding of the flexible elongated support member from the reel component and wherein said braking component and said reel component are configured such that said braking component is attached to said reel component so as to have a braking configuration and a non-braking configuration and such that said braking component is able to be centrifugally displaced from said non-braking configuration to said braking configuration.

* * * * *